US011767742B1

(12) United States Patent
Bradford, Jr.

(10) Patent No.: US 11,767,742 B1
(45) Date of Patent: Sep. 26, 2023

(54) SURFACE UNIT FOR DOWNHOLE PUMP

(71) Applicant: Floyd John Bradford, Jr., Houston, TX (US)

(72) Inventor: Floyd John Bradford, Jr., Houston, TX (US)

( * ) Notice: Subject to any disclaimer, the term of this patent is extended or adjusted under 35 U.S.C. 154(b) by 0 days.

(21) Appl. No.: 17/856,589

(22) Filed: Jul. 1, 2022

(51) Int. Cl.
*E21B 43/12* (2006.01)

(52) U.S. Cl.
CPC ..... *E21B 43/129* (2013.01)

(58) Field of Classification Search
CPC ..... E21B 43/129; E21B 43/13
See application file for complete search history.

(56) References Cited

U.S. PATENT DOCUMENTS

2014/0318763 A1* 10/2014 Hearn ..... E21B 43/129
166/105.5

* cited by examiner

*Primary Examiner* — Kristyn A Hall
(74) *Attorney, Agent, or Firm* — McCutcheon Joseph, PLLC

(57) ABSTRACT

Pump assemblies for subsurface fluid reservoirs include an upper portion connected to a fluid conduit extending to the surface, a lower portion connected to the upper portion and in fluid communication with a fluid reservoir of the wellbore, and a plunger assembly movably located within the upper and lower portion of the pump assembly. As the fluid pressure within the production tubing string, fluidly isolated from the inner tubing string, increases, fluid is forced into the pump assembly moving the plunger assembly upward to draw fluid into the lower portion of the pump and forces fluid out of the upper portion of the pump assembly and into the inner tubing string. As the fluid pressure within the production tubing string decreases, movement of the plunger assembly descends displacing fluid from the lower portion of the pump assembly into the upper portion through a fluid passageway extending through the plunger assembly.

14 Claims, 2 Drawing Sheets

Decompressing (Circulating) Mode

Decompressing (Circulating) Mode

Compressing Mode

SURFACE UNIT FOR DOWNHOLE PUMP

FIELD

Embodiments of the present invention relate, generally, to systems and methods usable in surface units in conjunction with subsurface pumps for removing fluids (e.g., hydrocarbons) from subterranean reservoirs, and more particularly, to fluid pumping systems and methods for, alternatively, pumping into and out of a wellbore.

BACKGROUND

Presently, low pressure reservoirs, incapable of producing fluid from the reservoir to the surface naturally, account for a majority of the hydrocarbon producing wells in the United States. There are various means of pumping fluid from these wells, such as the use of sucker rod pumps, hydraulic pumps, jet pumps, and semi-submersible electric pumps. Most of these depleted wells produce fluid at pressure and flow rates too low for the majority of existing pumps to operate efficiently and/or economically.

The most common method, used for producing these low pressure, low flow rate wells is the use of sucker rod pumping systems. Sucker rod pumping systems include a downhole plunger and cylinder type pump, connected to a surface unit (e.g., a pump jack) by connecting rods (e.g., sucker rods). Existing sucker rod systems include multiple limitations and difficulties inherent in their use. While the stroke length of the pump and the stroke frequency may be controlled through the selection of the pump jack size, pumping jacks are too costly, and each pump size is limited to a specific range of flow rates and depth of the reservoir. Once a pump unit is placed, it is cost prohibitive to change the pump jack, thus modification of stroke length and/or frequency is often impossible. Another large problem with conventional sucker rod systems relates to the sucker rods, themselves. Sucker rods include segments of metal or fiberglass rod that are connected together to form a continuous string of rods, normally several thousand feet in length when used in hydrocarbon wells. These rod strings are typically connected using pin and box connections (e.g., threaded connections). The process of connecting the rod string when running sucker rod segments into a wellbore, or disconnecting the string when removing rod segments from the wellbore, is time consuming and costly. Additionally, the length and weight of these rods, and the repeated reciprocation of the rods caused by the pump jack, often results in failure. The failure may commonly result in a parting of the sucker rod string. Another difficulty associated with the use of sucker rod strings is the position of the rod string within a tubing string (e.g., production tubing). When the system is operating, it is common for the rod string to contact the inner wall of the tubular string at various points, which results in wear of both the rod string and the tubular string, and can eventually cause failure of the well tubing string, as well as the rod string. Depending of the severity of the wellbore conditions, rod pumping systems can fail as often as once a month, quarterly, or semiannually, requiring significant repair and maintenance costs. The frequency and expense of necessary repairs and maintenance is often a significant factor that causes production of a well to become uneconomical. Failure rates in rod pumping systems are significantly more common in deviated and/or non-vertical wellbores.

There have been attempts to develop a pumping system which utilizes a plunger/cylinder-type downhole pump while eliminating the use of sucker rods, thereby eliminating the problems inherent in the use of sucker rods. Existing rodless pump systems typically include a spring mechanism in the subsurface pump that will displace the piston and lift the fluid from the pump chamber into the tubing string and toward the surface. Although, such systems eliminate use of a sucker rod string, they require a compression spring for lifting the produced fluid into the tubing string. Use of such a spring severely limits the stroke length and thus, the flow rate of the pump. Further, springs used in this manner tend to fail due to wear and/or the accumulation of debris carried into the pump.

Other existing rodless pumps replace the physical spring with a gas chamber. When pressure is applied to the tubing string, a piston will compress the gas within the chamber, and when the pressure is relieved, the gas will expand to lift fluid into the tubing string. These systems allow for a longer stroke length and thus much higher efficiency, but introduce additional problems. A major problem inherent in the use of rodless pumps is that, unlike sucker rod pumps, a rodless pump does not have a precisely defined stroke length. In a rodless pump, the stroke length is affected by the length of time that pressure is applied to the fluid in the tubing string during each cycle, by the compressibility of the fluid in the tubing string, and by the amount of ballooning of the tubing that occurs. The stroke length is also influenced by the pressure in the gas chamber, since the pressure in the gas chamber must be sufficient to support the hydrostatic pressure of the entire column of fluid extending to the surface. Additionally, having to hydraulically push against the added force of this pressure makes the rodless pump systems more inefficient. At the end of each upstroke and downstroke, enough force is applied to the plunger to cause the plunger to strike the bottom of the barrel with a significant impact, causing excessive wear and potential damage. Thus, unlike sucker rod pumps, rodless pumps are difficult to design in a manner that enables the maximum stroke to be utilized without the plunger contacting the barrel at the end of the upstroke and downstroke, and severely limiting the usable life of such pumps.

Other rodless pumps attempt to overcome these severe plunger impacts through use of dampening mechanisms, such as elastomer barriers, springs, and/or other types of dampeners, at both the top and bottom of the plunger's stroke. However, such rodless pump systems still utilize a downhole gas source within the pump to force the plunger assembly downward after the surface pressure source releases the pressure being exerted on the downhole pump. The gas pressure source requires a substantially self-contained pressure chamber, which can be part of the pump, can be positioned downhole, and can be used to contain a substantially compressible gas. The pressure chamber can be precharged with a gas, such as nitrogen. Although this arrangement is an improvement over preceding pumps, particularly conduit subject to plunger impact, it still possesses inherent limitations. For example, this arrangement of pump requires a very high precharge pressure in the gas chamber. In addition, with the use of this arrangement the pump may suffer from a short piston life due to gas and/or fluid leakage and contamination, and the pump will require bleeding the substantial gas chamber pressure whenever retrieving the pump to the surface, exposing personnel to the dangers inherent to such operations.

Furthermore, some rodless pumps attempt to power the downhole component by pressurizing the production fluid. (A non-limiting example of such a rodless pump system is U.S. Pat. No. 9,784,254 to Bradford). In many reservoirs, however, the production fluid contains gaseous components (e.g., natural gas) that are more highly compressible than liquid components of the production fluid. The compressibility of the gaseous components can cause a wasteful amount of extra pressurizing from the surface of the wellbore. That is, the pressurizing from the surface of the wellbore must pump in fluid to compress the gaseous components, which requires an increased amount of pumping from the top of the wellbore. The extra fluid that is used to compress the gaseous components is difficult to predict; and therefore, a large reservoir is required on the power side to make sure that the downhole pump is properly pressurized. Compressing the gaseous components also increases the time and energy needed to power the downhole pump, making the pumping process less efficient.

A need therefore exists for an improved surface unit to replace rods, pump jacks, and downhole spring-back mechanisms within the pump, which protects tubing, eliminates inaccessible gas chambers, reduces impact problems, and efficiently manages gas in solution, thereby increasing reliability and efficiency and having a substantial usable life.

Embodiments usable within the scope of the present disclosure meet these needs and improve upon existing designs by eliminating the mixing of power fluid and production fluid.

BRIEF DESCRIPTION OF THE DRAWINGS

In the detailed description of various embodiments usable within the scope of the present disclosure, presented below, reference is made to the accompanying drawings, in which.

DETAILED DESCRIPTION OF THE EMBODIMENTS

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, order of operation, means of operation, equipment structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products, and may include simplified conceptual views as desired for easier and quicker understanding or explanation. As well, the relative size and arrangement of the components may differ from that shown and still operate within the spirit of the invention.

Moreover, it will be understood that various directions such as "upper," "lower," "bottom," "top," "left," "right," and so forth are made only with respect to explanation in conjunction with the drawings, and that the components may be oriented differently, for instance, during transportation and manufacturing as well as operation. Because many varying and different embodiments may be made within the scope of the concepts herein taught, and because many modifications may be made in the embodiments described herein, it is to be understood that the details herein are to be interpreted as illustrative and non-limiting.

As described in detail below, the disclosed embodiments include surface pumping units capable of actuating subsurface pumping devices downhole in a wellbore. The surface units include equipment necessary to create two independently pressurized fluid regimes. One fluid regime (e.g., the high power side) may be capable of delivering intermittent application of pressure, which the other fluid regime (e.g., the low-power balance side) reacts to in order to accomplish at least two independent tasks. The first task is actuating a downhole pump that may be installed within the wellbore by applying higher pressured fluids which lifts production fluids to the surface and simultaneously draws new production fluids into the downhole pump. The second task may be reducing the pressure on high power fluids, re-capturing the high power fluids, and returning the actuated subsurface pump to the original down position while internally transferring new production fluids within the downhole pump in response to the lower pressured balance side fluids working in unison with the power side.

Figure 1:
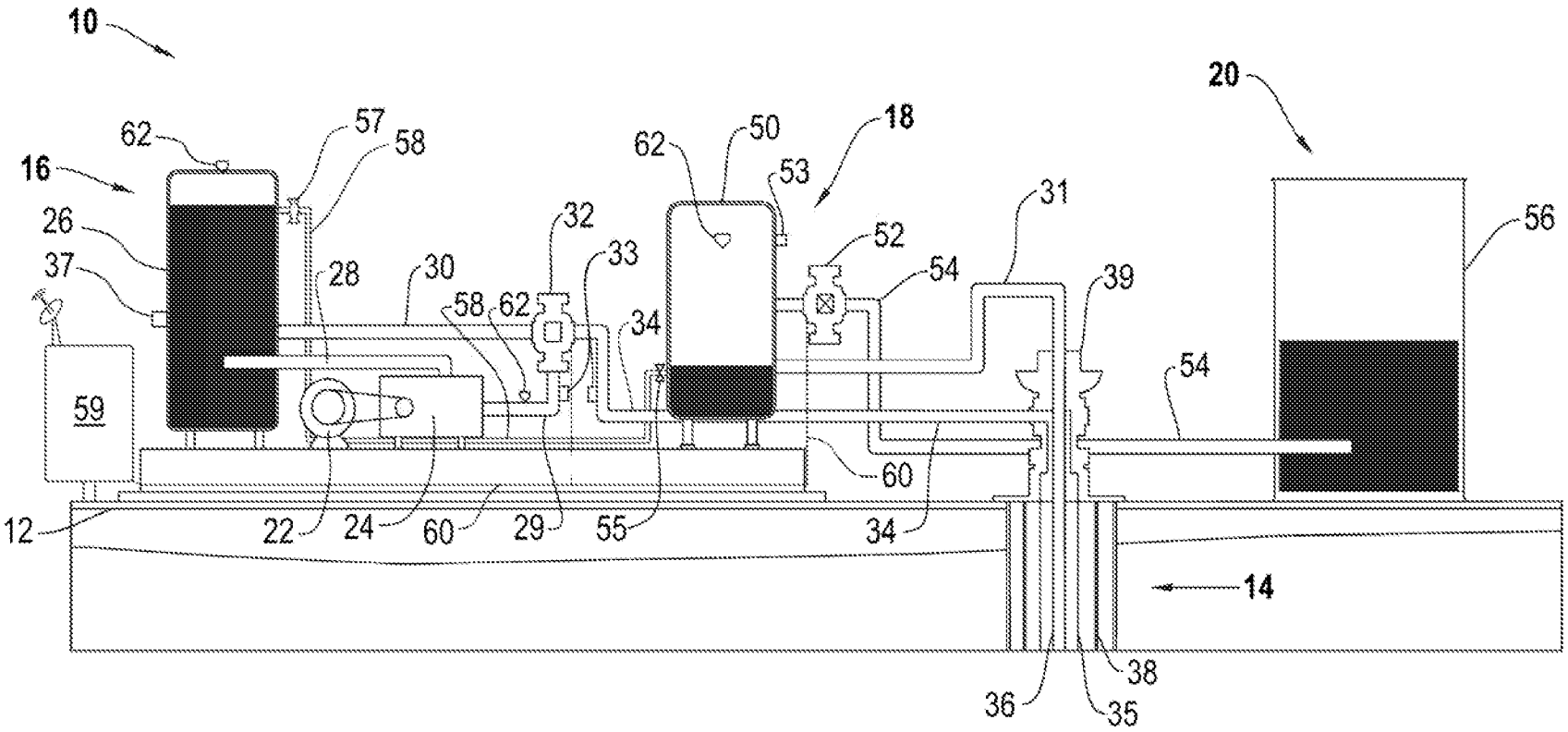
FIG. 1 is a perspective view of an embodiment of a surface unit for a downhole pump in the power fluid compression pumping stage, usable within the scope of the present disclosure.

Referring now to FIG. 1, a perspective view of a surface unit 10 is shown and configured to be placed on a surface 12 in proximity to a wellbore 14. The wellbore 14 may be drilled to a depth of several thousand feet below the surface 12 and may have had previous pumping components or fluid extraction systems that could have been removed or replaced by the surface unit 10. The surface unit 10 may include several systems that may serve one or several wellbores 14 located in proximity to each other. For example, the surface unit 10 may include a power system 16, an extraction system 18, and a storage system 20. The power system 16 may include a motor 22 used to power a surface pump 24. The motor 22 may be an electric or combustion powered engine with 10 horsepower, 15 horsepower, 20 horsepower, 25 horsepower, 30 horsepower, or a more powerful motor in order to quickly and/or efficiently provide power to the surface pump 24. In certain embodiments, the motor 22 may include a low horsepower motor for more efficient extraction of the production fluid. For example, the wellbore 14 may have slowed in production such that only a few hundred gallons of production fluid are produced for a given time. For these low-production wellbores, a small, efficient motor 22 is optimal. In certain other embodiments, a greater amount of production fluid may be pooled at the bottom of the wellbore 14, for which a larger motor 22 can economically provide power to the surface pump 24.

The motor 22 drives the surface pump 24 to draw power fluid from a circulating tank 26. The surface pump 24 may include, for example, a triplex pump that holds and pressurizes the power fluid for injection and introduction into the wellbore 14. The circulating tank 26 may have an amount of power fluid that is determined when the surface unit 10 is installed. An operator may change the amount of fluid in the circulating tank 26 depending on the need for additional pressure and/or fluid within the power system 16. In certain embodiments, the amount of power fluid is optimally maintained at consistent levels within the circulating tank but may change during operation. Also, as explained in detail below, the power fluid is operated separately and independently from the production fluid and potential sources of gas or compressible fluids. The power fluid may be any viscous fluid and may include particulate or dissolved components to tailor the power fluid to a particular wellbore 14. In particular, the power fluid may include lubricants, corrosion inhibitors, and other fluids to further decrease any wear and tear on the components within the wellbore 14, the downhole pump (not shown), the surface unit 10, or combinations thereof.

The surface pump 24 may discharge power fluid, for example, at a rate of 11.4 gallons per minute, by drawing fluid from the circulating tank 26 using circulating conduit 28, and discharge such power fluid through pump conduit 29 to power fluid control valve 32. After passing through power fluid control valve 32, the power fluid can return to circulating tank 26 through return conduit 30. The flow direction of the power fluid can be controlled by power fluid control valve 32, as shown. In FIG. 1, the power fluid control valve 32 is open, allowing fluid to flow from surface pump 24, through pump conduit 29, through power fluid control valve 32, through return conduit 30, and back into circulating tank 26. The power fluid control valve 32 in this position also allows power fluid contained inside the production tubing 35 of the wellbore 14, to return to circulating tank 26 through wellhead control conduit 34, power fluid control valve 32, and return conduit 30 leading back to circulating tank 26. The production tubing 35 can connect the surface unit 10 to the downhole pump (not shown), and the production tubing 35 may surround an inner tubing string 36 acting as a conduit for fluid production from a downhole pump (not shown). In certain embodiments, the production tubing 35 connects the downhole pump (not shown) to a wellhead 39, through wellhead control conduit 34, to the power fluid control valve 32. On an exterior side of the production tubing 35, the wellbore 14 may also include a wellbore casing 38 to protect the wellbore 14 from caving in or crushing the production tubing 35. The surface pump 24 may constantly or variably run, even when the power fluid control valve 32 is closed. Constant or variable running of the surface pump 24 can enable smooth and consistent operation of the motor 22 consistent with changing pressure requirements.

Figure 2:
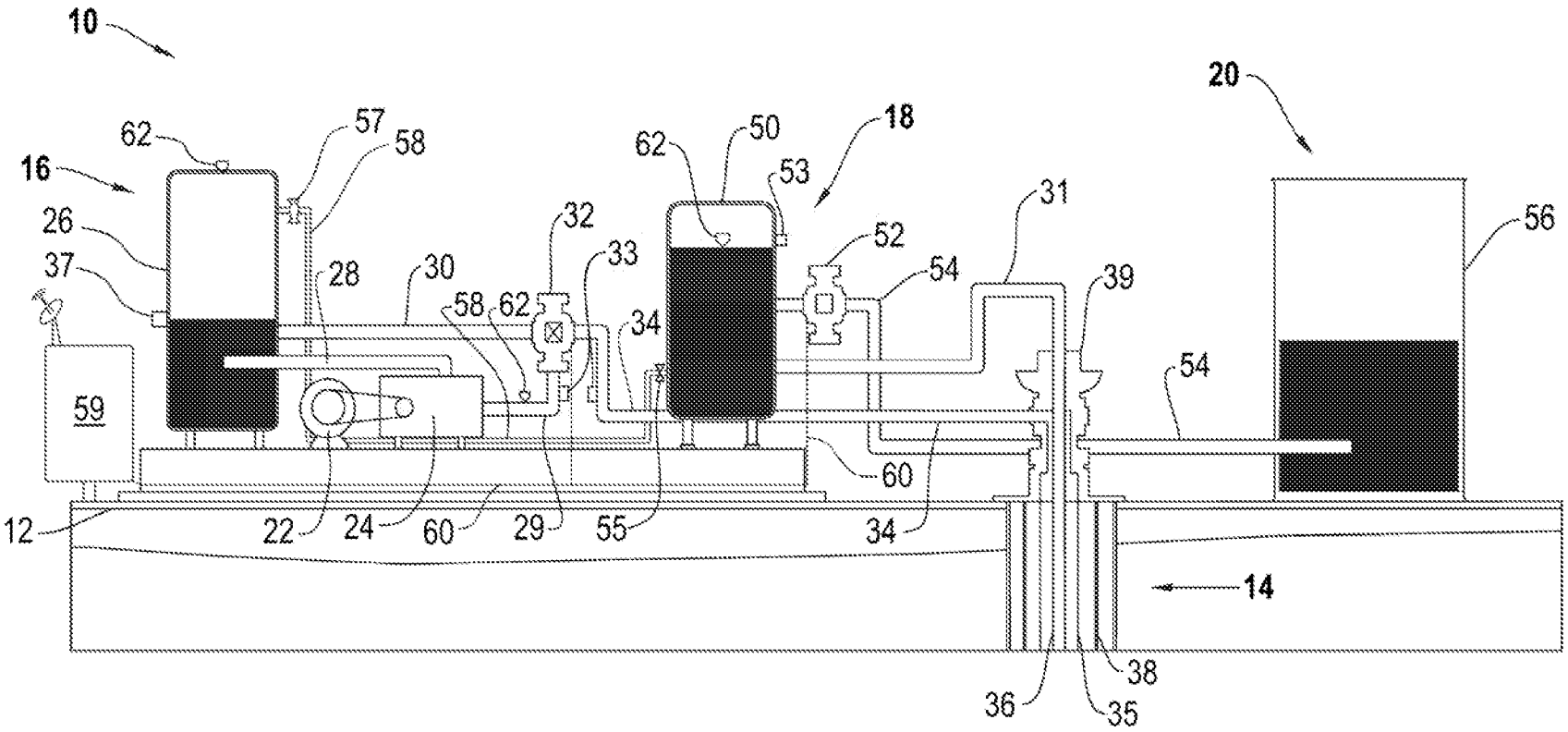
FIG. 2 is a perspective view of an embodiment of a surface unit for a downhole pump in the power fluid decompression pumping stage, usable within the scope of the present disclosure.

To control the flow of the power fluid, the power fluid control valve 32 may be operated by detecting the pressure changes within pump conduit 29 and/or wellhead control conduit 34, together or individually. The pressure changes may be detected by mechanical and/or electrical sensors 33 that convey signals to one or more of: the motor 22, the power fluid control valve 32, or other indicators such as level switches, pop-off valves, electrical boxes, or other components within the surface unit 10. Mechanical or electrical level sensor 37 in circulating tank 26 may detect fluid levels and transmit signals to switch off the entire surface unit 10. For example, in certain embodiments of the surface unit 10 with a downhole pump, the increase in pressure within wellhead control conduit 34 and the production tubing 35 may cause the downhole pump to raise a plunger assembly within the downhole pump. When the plunger assembly is raised to the highest extent inside of the downhole pump (not shown), the pressure within the production tubing 35 will spike. The spike in pressure may be detected by the sensors 33 on pump conduit 29 and/or wellhead control conduit 34; and in response, the power fluid control valve 32 can switch the flow from going into the wellbore 14. As shown in FIG. 2, the power fluid control valve 32 changes the power fluid flow from flowing through wellhead control conduit 34, to flowing through return conduit 30 into the circulating tank 26 when such valve is open, rather than flowing through wellhead control conduit 34 when such valve is closed.

When the pressure in the production tubing 35 is released by the power fluid control valve 32, the plunger assembly in the downhole pump begins to drop. In certain embodiments, the de-pressurizing of the power fluid in the production tubing 35 may cause the downhole pump to perform other pumping actions. For example, as the plunger assembly descends, it displaces production fluid out of a lower chamber. The displaced production fluid is moved to an upper chamber for subsequent displacement on an ensuing stroke up the inner tubing string 36 to the wellhead 39. Other embodiments of a downhole pump may make additional uses of pressurizing and releasing pressure on power fluid within the production tubing 35.

When the pressure in the production tubing 35 drops below a certain threshold, the power fluid control valve 32 closes again (as detected by the sensors), and the surface pump 24 again builds pressure within the production tubing 35. In certain embodiments, the increase in pressure within the production tubing 35 causes production fluid to flow up through the inner tubing string 36, which passes through the wellhead 39, and continues through wellhead balance conduit 31 into a balance tank 50. The balance tank 50, in certain embodiments, is a sealed vessel that has a gas cap on top of the fluid. This gas cap may act as a gas-spring at the top of the balance tank 50 such that the gas is compressed and decompressed as the production fluid flows into and out of the balance tank 50 via wellhead balance conduit 31. The gas-spring ensures that when the power fluid control valve 32 opens, releasing the buildup of pressure in the production tubing 35, the pressure built up in the gas cap, which is contained in the balance tank 50, pushes the fluid contained in wellhead balance conduit 31 through wellhead 39, down the inner tubing string 36, back down to the downhole pump. In turn, this action displaces power fluid contained in the production tubing 35 back up through the wellhead 39, and into the wellhead control conduit 34. The wellhead control conduit 34 then takes the power fluid through the open power fluid control valve 32 and returns the power fluid through the return conduit 30 to the circulating tank 26.

In addition to the balance tank 50, the extraction system 18 may include a dump valve 52 that opens to convey the production fluid from the balance tank 50 through the tailgate conduit 54 to the storage system 20. In certain embodiments, the dump valve 52 opens when the production fluid rises to a certain level within the balance tank 50. In certain embodiments, the dump valve 52 opens when production fluid falls to a certain level within the balance tank 50. The dump valve 52 may be mechanically or electrically connected to level sensor(s) 53 within the balance tank. 50 to determine a level of production fluid within the balance tank 50. The sensors may be connected to a relay box to convey the signal to the dump valve 52. For example, the dump valve 52 may open each cycle in which the surface pump 24 pressurizes the production tubing 35. In certain other embodiments, however, the dump valve 52 may allow for multiple cycles to flow into the balance tank 50 before the dump valve 52 is opened.

In an embodiment, surface unit 10 may also include a fluid replenishment system comprising a refill valve 57 and refill conduit 58. When the fluid levels in circulating tank 26 drop below a predetermined point, the refill valve 57 opens and fluid recirculates back from the balance tank 50 into the circulating tank 26. In an embodiment, level sensor 37 located within circulating tank 26 controls the opening of the refill valve 57, allowing production fluids to flow from the fluid balance tank 50 through refill conduit 58 to the circulating tank 26. In an embodiment, the fluid balance tank 50 contains a fluid release valve 55 connecting to refill conduit 58. When the fluid levels in the balance tank 50 exceed a predetermined level, the fluid release valve 55 will open, making fluid available to the refill conduit 58 connected to the refill valve 57, allowing fluids to flow from the balance tank 50 to the circulating tank 26.

In an embodiment, an electrical box 59 can be employed within the surface unit 10 which may power and receive impulses from a variety of components on the surface unit 10 including, but not limited to: switches, timers, computers, electrical and/or gas motors, and to receive impulses from the various sensors (including level sensors 37, 53 and/or pressure sensors 33), and through electrical conduit 60 (indicated with a broken line to distinguish from fluid conduits) activate various timers, relays, and/or computers within the electrical box 59. Further, the various impulses received by the electrical box 59 and its internal components may then be transmitted by electrical conduit 60 and other means to activate other devices used to operate the surface unit 10, such as power fluid control valve 32 and dump valve 52, as well as perform other functions such as offsite communications via satellite, radio, wi-fi, or other wireless technology. In an embodiment, electrical box 59 may be remotely programmable so the unit can be activated and operated without direct supervision.

In an embodiment, the surface pump 24 (or pump conduit 29), the circulating tank 26, and the balance tank 50 may be equipped with high-pressure pop-off valves 62 as safety mechanisms for pressure relief. These pop-off valves 62 may be connected to a single drain conduit feeding into the tailgate conduit 54 and then into storage tank 56. In an embodiment, these pop-off valves 62 may have varying thresholds; by way of example, and not limiting any embodiment to any particular pressure rating, the valve located on the surface pump 24 may be rated for 3,000 lbs, the valve on the circulating tank 26 may be rated for 1,440 lbs, and the valve on the balance tank 50 may be rated for 500 lbs.

When the production fluid flows out through the dump valve 52, a tailgate conduit 54 can be used to convey the production fluid to the storage system 20, as shown. The storage system 20 may include a storage tank 56. The storage tank 56 may be a large tank which does not directly contribute to the pressures within the production tubing 35, the inner tubing string 36, or otherwise within the wellbore 14. The storage system 20 may also include tank vessels, trucks, rail cars, pipes, or other transportation or refining treatment for the production fluid.

While various embodiments usable within the scope of the present disclosure have been described with emphasis, it should be understood that within the scope of the appended claims, the present invention can be practiced other than as specifically described herein.

The invention claimed is:

1. A surface pumping system for actuating a subsurface pump in a wellbore, the system comprising:

a power side comprising a circulating tank, a motorized pump, and a power fluid control valve, wherein the motorized pump conveys a power fluid from the circulating tank to the power fluid control valve, and wherein the power fluid control valve conveys the power fluid back to the circulating tank when the power fluid control valve is open, or conveys the power fluid into production tubing located within the wellbore when the power fluid control valve is closed; and an extraction side comprising a balance tank, wherein the balance tank contains production fluid and pressurized gas, wherein the balance tank receives production fluid through an inner tubing concentric to the production tubing located within the wellbore; and wherein the power side actuates the subsurface pumping device by closing the power fluid control valve, conveying power fluid down into the production tubing until the pressure change actuates the subsurface pump, which in turn conveys production fluid up the inner tubing and into the balance tank, raising the balance tank's production fluid level and pressurizing the gas, and then opening the power fluid control valve, allowing the de-pressurized power fluid to flow back into the circulating tank and the pressurized gas in the balance tank to push the production fluid out of the balance tank, down through the inner tubing actuating the subsurface pump, causing the power fluid to return up through the production tubing through the power fluid control valve back into the circulating tank.

2. The system of claim 1, further comprising a storage system, wherein the storage system receives production fluid from the balance tank.

3. The system of claim 2, wherein the balance tank comprises a dump valve, wherein the dump opens and closes according to the level of production fluid in the balance tank.

4. The system of claim 3, wherein the storage system further comprises a tailgate conduit leading from the dump valve to at least one storage tank.

5. The system of claim 4, further comprising a circulating tank level sensor and a balance tank level sensor.

6. The system of claim 5, wherein the balance tank level sensor causes the dump valve to open to the tailgate conduit if the volume of fluid in the balance tank exceeds a predetermined threshold and closes if below such predetermined threshold.

7. The system of claim 5, wherein the circulating tank is connected to the balance tank via a refill conduit having a refill valve proximate to the circulating tank and a release valve proximate to the balance tank.

8. The system of claim 7, wherein the circulating tank level sensor opens the refill valve and receives production fluid from the balance tank through the refill conduit into the circulating tank when the fluid levels in the circulating tank fall below a predetermined threshold.

9. The system of claim 7, wherein the balance tank level sensor opens the release valve and conveys production fluid from the balance tank through the refill conduit to the refill valve on the circulating tank when the fluid levels in the balance tank exceed a predetermined threshold.

10. The system of claim 1, wherein the actuation of the power fluid control valve is determined by the pressure of the power fluid as detected by at least one pressure sensor.

11. The system of claim 10, wherein the at least one pressure sensor is located on a conduit connecting the motorized pump and the power fluid control valve, a conduit connecting the production tubing and the power fluid control valve, or both.

12. The system of claim 1, further comprising an electrical control box, wherein the electrical control box is operably connected to the power fluid control valve and the dump valve, and wherein the electrical control box directs the opening and closing of the power fluid control valve and the dump valve based on at least one level sensor, a pre-programmed sequence, remotely transmitted commands, or combinations thereof.

13. The system of claim 12, wherein the electrical control box can receive remotely transmitted commands and transmit sensor data from the system via satellite, radio, wi-fi, or direct electrical connection.

14. The system of claim 1, wherein the motorized pump, the circulating tank, the balance tank, or combinations thereof, are equipped with pop-off valves.

* * * * *